US011644262B2

(12) United States Patent
Liu

(10) Patent No.: US 11,644,262 B2
(45) Date of Patent: May 9, 2023

(54) FIREARM WITH ELECTRONIC FIRING MECHANISM

(71) Applicant: Ray Ruizhi Liu, Richmond (CA)

(72) Inventor: Ray Ruizhi Liu, Richmond (CA)

( * ) Notice: Subject to any disclaimer, the term of this patent is extended or adjusted under 35 U.S.C. 154(b) by 0 days.

(21) Appl. No.: 17/468,200

(22) Filed: Sep. 7, 2021

(65) Prior Publication Data

US 2022/0074695 A1 Mar. 10, 2022

Related U.S. Application Data

(60) Provisional application No. 63/076,119, filed on Sep. 9, 2020.

(51) Int. Cl.

| | |
|---|---|
| ***F41A 19/63*** | (2006.01) |
| ***F41A 19/59*** | (2006.01) |
| ***F41A 3/66*** | (2006.01) |
| ***F41A 19/10*** | (2006.01) |

(52) U.S. Cl.

CPC ..... *F41A 19/59* (2013.01); *F41A 3/66* (2013.01); *F41A 19/10* (2013.01); *F41A 19/63* (2013.01)

(58) Field of Classification Search

CPC ..... F41A 19/58; F41A 19/59

See application file for complete search history.

(56) References Cited

U.S. PATENT DOCUMENTS 3,736,837 A * 6/1973 Kaprelian ..... F41A 19/63 102/202.8
4,563,828 A * 1/1986 Kriegeskorte ..... F41A 19/58 89/135
5,755,056 A * 5/1998 Danner ..... F41A 3/22 42/84
6,397,508 B1 * 6/2002 Constant ..... F41A 17/04 42/84
10,139,181 B1 * 11/2018 Wild ..... F41A 19/59
10,309,743 B2 * 6/2019 Rami ..... F41A 3/26

FOREIGN PATENT DOCUMENTS

FR 463216 A * 2/1914 ..... F41A 19/58

OTHER PUBLICATIONS

Cliff Gromer, "Remington's Model 700 EtronX Centerfire Target Rifle Redefines The Big Bang Theory," Popular Mechanics, https://www.popularmechanics.com/technology/gear/reviews/a211/1277311/, Dec. 7, 2004, Accessed Jul. 21, 2021.

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A firearm with electronic firing mechanism has a frame including a barrel chambered for a conventionally primed cartridge, a bolt operably connected to the frame and having a bolt face facing the chamber and defining a bolt face aperture, an electrode connected to the bolt and having a tip received in the bolt face aperture and facing the chamber, the tip being configured to contact a primer of a centerfire cartridge received in the chamber when the bolt is in a battery condition, the electrode being electrically isolated from the bolt and from the frame, an electric power delivery facility having a first connection to the electrode and a second connection to at least one of the barrel, the bolt and the frame, a trigger operably connected to the electric power delivery facility, and the electric power delivery facility operable such that the primer discharges the centerfire cartridge.

18 Claims, 5 Drawing Sheets

FIREARM WITH ELECTRONIC FIRING MECHANISM

CROSS-REFERENCE TO RELATED APPLICATION

This application claims the benefit of U.S. Provisional Patent Application No. 63/076,119 filed on Sep. 9, 2020, entitled "Electronic Firing Mechanism for Use with Impact-primed Ammunition," which is hereby incorporated by reference in its entirety for all that is taught and disclosed therein.

FIELD OF THE INVENTION

The present invention relates to firearms, and more particularly to a firearm with electronic firing mechanism that enables electrical initiation of conventional percussively fired primers.

BACKGROUND AND SUMMARY OF THE INVENTION

Firearms with electronic firing mechanisms have significant advantages over conventional mechanical firing mechanisms. These include faster lock time, lighter trigger weights, better integration with intelligent target acquisition systems, and improved rate of fire control in fully automatic firearms. Current electronic firing methods often utilize ammunition with specialized electronic primers to detonate the main powder charge. Electronic primers may contain either a resistive element, which relies on low-voltage and high current to heat up to the autoignition temperature of the priming compound, or a spark gap, which relies on a high voltage pulse to ignite the priming compound between the gap. Such an arrangement has the drawbacks of requiring specialized primers or ammunition in the firearm rather than conventional ammunition. This ammunition may be limited in supply and be subject to a higher cost than conventional ammunition, reducing adoption. In general, consumer adoption of a new cartridge is more challenging compared to the adoption of a new firearm utilizing an existing cartridge. In addition, electronic initiation has also historically been less reliable compared to mechanical firing mechanisms because of a lack of control over firing parameters. Electronic firing systems also rely on various transformers or capacitors to develop the current and voltage required to ignite the priming compound, which increases the weight and bulk of the firing mechanism. These drawbacks have been the main factors preventing the proliferation of electronic firing systems.

Conventional percussively primed cartridges rely on a mixture of shock-sensitive explosive, which is normally initiated using a mechanical firing pin, which strikes the mixture. The explosive can also be initiated through heating to the auto-ignition temperature. Conventional cartridges have numerous advantages over specialized electronic cartridges, including widespread supply, lower cost, and user familiarity.

Therefore, a need exists for a new and improved firearm with electronic firing mechanism that enables electrical initiation of conventional percussively fired primers. In this regard, the various embodiments of the present invention substantially fulfill at least some of these needs. In this respect, the firearm with electronic firing mechanism according to the present invention substantially departs from the conventional concepts and designs of the prior art, and in doing so provides an apparatus primarily developed for the purpose of enabling electrical initiation of conventional percussively fired primers.

The present invention provides an improved firearm with electronic firing mechanism, and overcomes the above-mentioned disadvantages and drawbacks of the prior art. As such, the general purpose of the present invention, which will be described subsequently in greater detail, is to provide an improved firearm with electronic firing mechanism that has all the advantages of the prior art mentioned above.

To attain this, the preferred embodiment of the present invention essentially comprises a frame including a barrel chambered for a conventionally primed cartridge, a bolt operably connected to the frame and having a bolt face facing the chamber and defining a bolt face aperture, an electrode connected to the bolt and having a tip received in the bolt face aperture and facing the chamber, the tip being configured to contact a primer of a centerfire cartridge received in the chamber when the bolt is in a battery condition, the electrode being electrically isolated from the bolt and from the frame, an electric power delivery facility having a first connection to the electrode and a second connection to at least one of the barrel, the bolt and the frame, a trigger operably connected to the electric power delivery facility, and the electric power delivery facility operable in response to actuation of the trigger to apply a voltage between the first and second connections, such that thermal energy at a contact between the electrode tip and the primer discharges the centerfire cartridge. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
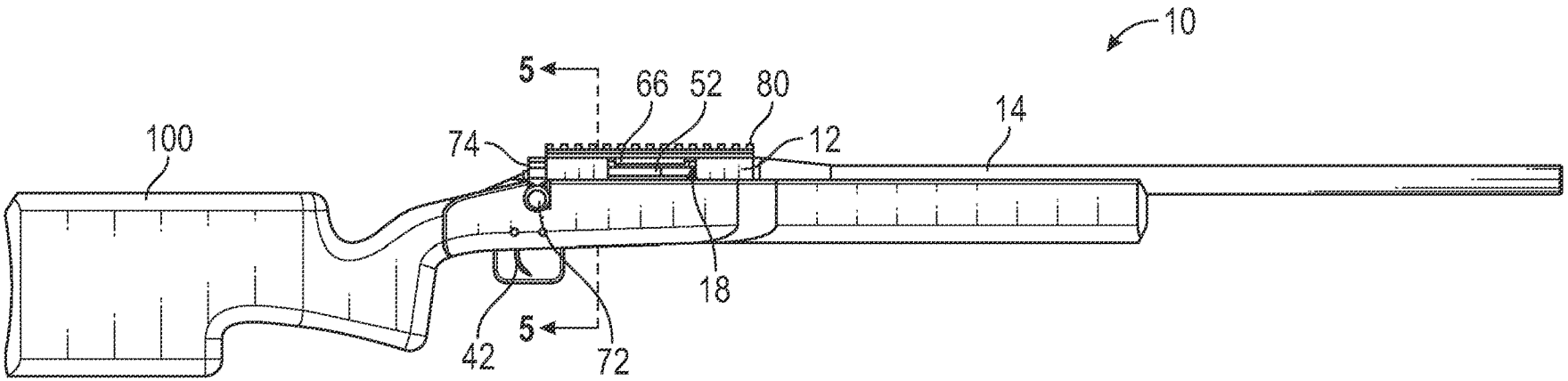
FIG. 1 is a right side view of the current embodiment of a firearm with electronic firing mechanism constructed in accordance with the principles of the present invention.

An embodiment of the firearm with electronic firing mechanism of the present invention is shown and generally designated by the reference numeral 10.

Figure 2:
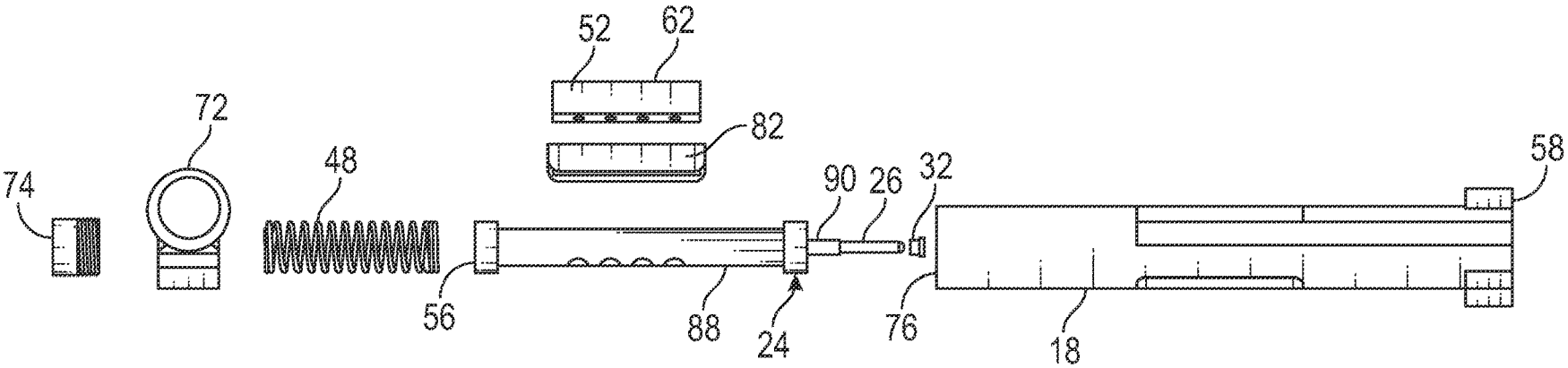
FIG. 2 is an exploded view of the bolt of FIG. 1.
Figure 3:
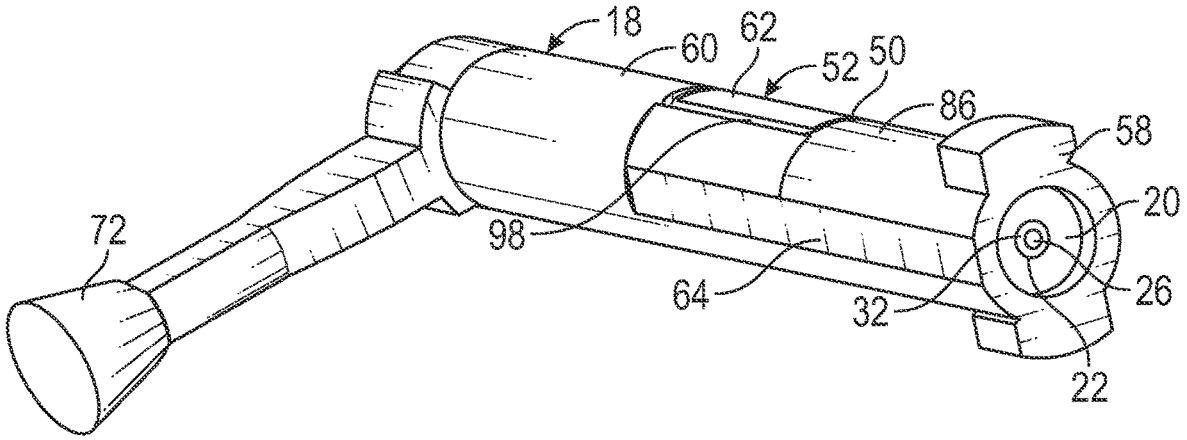
FIG. 3 is a front isometric view of the bolt of FIG. 1.
Figure 4:
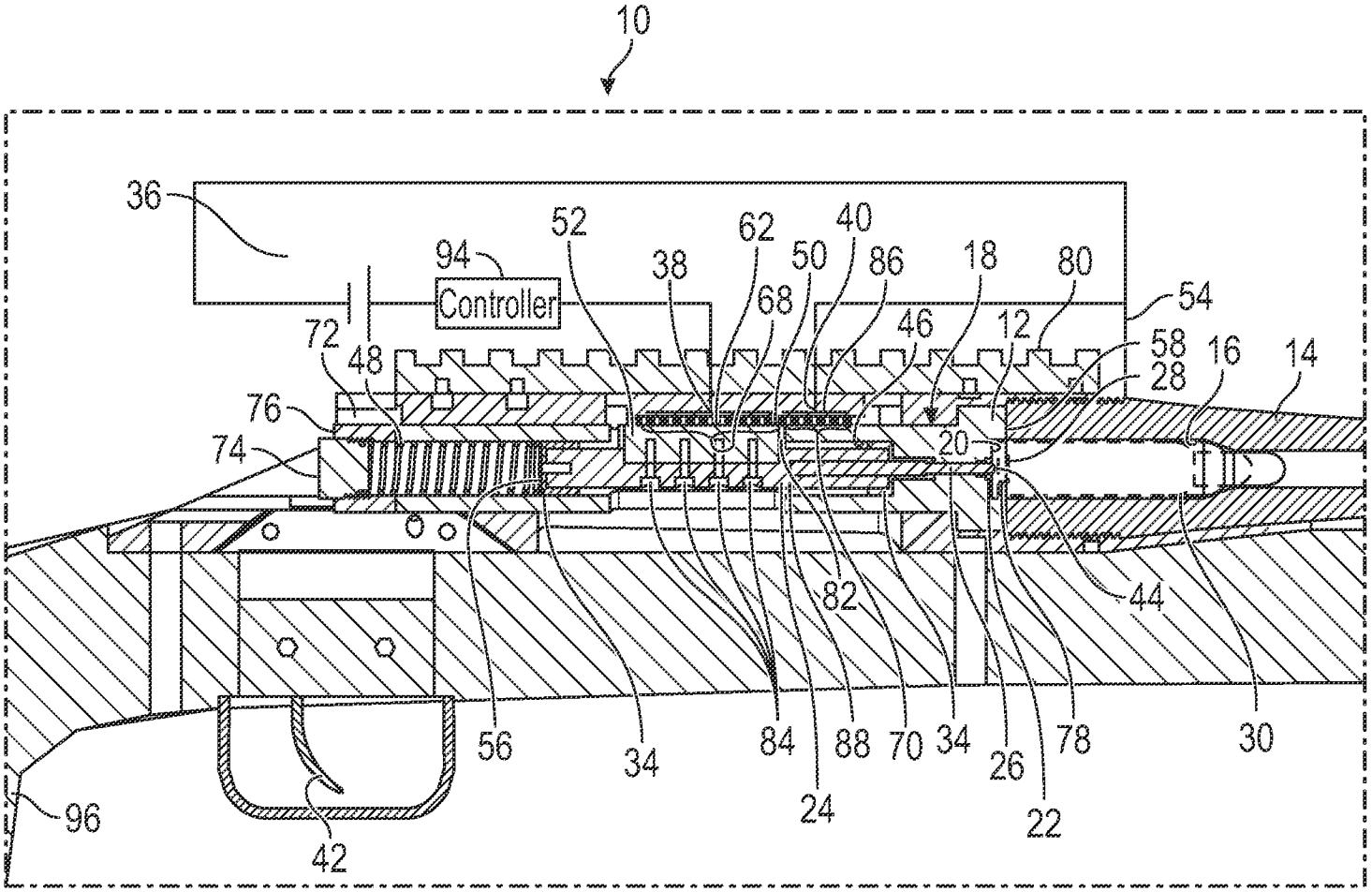
FIG. 4 is a side sectional enlarged fragmentary view of the firearm with electronic firing mechanism of FIG. 1.
Figure 5:
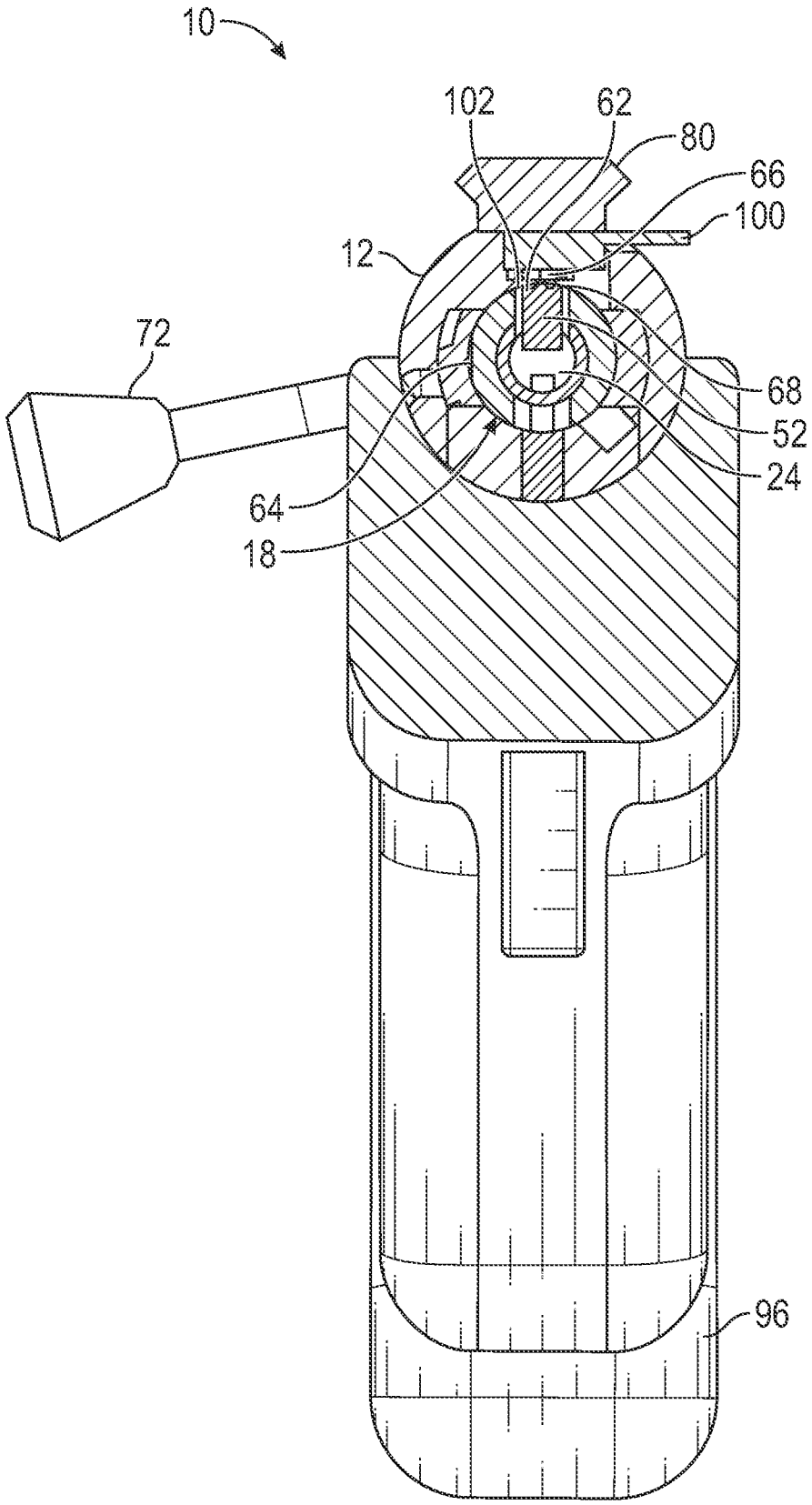
FIG. 5 is a front sectional view of the firearm with electronic firing mechanism taken along line 5-5 of FIG. 1.
Figure 6:
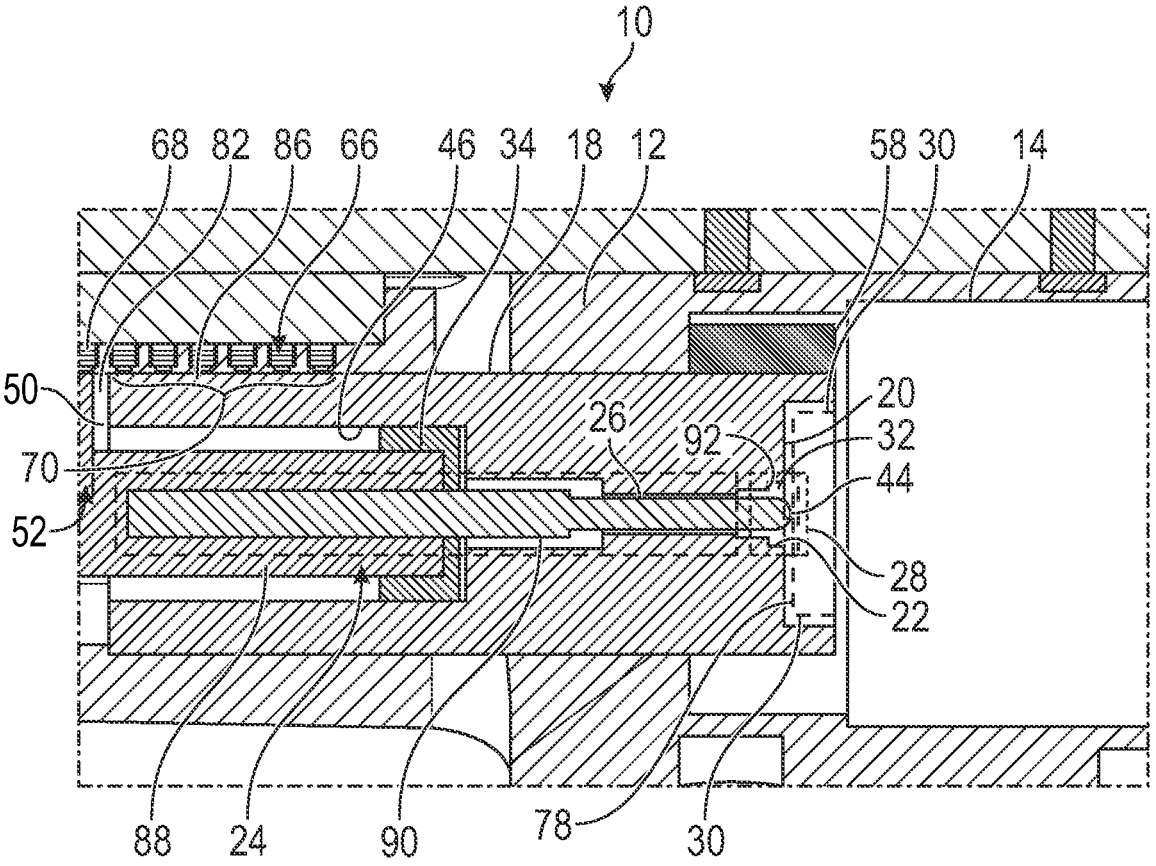
FIG. 6 is a side sectional enlarged fragmentary view of the firearm with electronic firing mechanism of FIG. 1.

FIGS. 1 & 4-6 illustrate the improved firearm with electronic firing mechanism 10 of the present invention. FIGS. 2 & 3 illustrate the improved bolt 18 of the present invention. More particularly, the firearm with electronic firing mechanism has a frame 12 including a barrel 14 having a chamber 16 that is chambered to receive a conventionally primed cartridge. A "conventionally primed cartridge" is defined as a cartridge having a primer that is discharged by impact of a firing pin. The conventionally primed cartridge is a centerfire cartridge 30 received in the chamber and having a primer 28 operable to discharge the centerfire cartridge in response to a forceful mechanical impact greater than a selected safety threshold. Primer sensitivity is measured in ounce-inches, which is a measure of energy like Joules. This amount is established by taking a steel ball of a selected weight and dropping it from a set height to determine if the centerfire cartridge discharges upon impact.

The frame 12 receives a bolt 18 operably connected to the frame and having a bolt face 20 facing the chamber 16 and defining a bolt face aperture 22. An electrode 24 is connected to the bolt and has a tip 26 received in the bolt face aperture and facing the chamber. The tip is configured with a taper to contact the primer 28 of the centerfire cartridge 30 received in the chamber when the bolt is in a battery condition. The contact area 44 between the tip and the primer is reduced to increase the electrical resistance. When electrical current is passed through the tip and into the contact area, the increased electrical resistance results in heat accumulating at the base of the primer, which eventually ignites the primer. The electrode is electrically isolated from the bolt and from the frame by an insulating spacer 32 that encircles the tip and two insulating spacers 34 that encircle the electrode rearward of the tip, such that the insulating spacers are between the electrode and the bolt. An electric power delivery facility 36 has a first connection 38 to the electrode and a second connection 40 to at least one of the barrel, the bolt and the frame. While the electronic firing mechanism 10 works only with one of these connections, preferably the barrel, bolt, and frame are all connected. This reduces electrical resistance between the cartridge case and the firing controller allowing for more efficacy and quicker lock times. A trigger 42 is operably connected to the electric power delivery facility. The electric power delivery facility is operable in response to actuation of the trigger to apply a voltage between the first and second connections, such that thermal energy at the contact area between the electrode tip and the primer discharges the centerfire cartridge.

In the current embodiment, the bolt 18 defines a bore 46, and the electrode 24 is received within the bore. The tip 26 of the electrode protrudes from the bolt face 20. The electrode remains stationary during discharge of the firearm. The electrode is spring biased with respect to the bolt, toward the chamber 16, by a spring 48. The spring is captured between the rear end 56 of the electrode and a threaded end cap 74 connected to the rear end 76 of the bolt. The electrode reciprocates a limited distance with respect to the bolt, which is less than 0.05 inch. Longer distances could introduce the undesirable possibility of slam fire in certain configurations. Although the spring biases the electrode forward, the biasing force is a safe and gentle spring force less than 100 g that is far less than would be needed to mechanically discharge the primer 28 like a conventional firing pin.

The bolt 18 defines a lateral opening 50, and an electrode element 52 connected to the electrode 24 extends through the lateral opening and has an exposed contact face/electrode contact surface 62. The bolt is an elongated body, and the lateral opening is forward of the rear end 76 of the bolt, preferably at an intermediate location along the length of the bolt, and closer to a forward end 58 of the bolt than to the rear end of the bolt. The most desirable location is as close forward as possible while still being within the opening of the ejection port when the bolt is closed so an electrical contact facility 66 having a plurality of flexible contacts 68, 70 is located at the ejection port. The objective of a more forward location is to position the electrode element such that electrical resistance resulting from a long electrode is avoided. The bolt has a lateral surface 60 including an electrode contact surface 62 isolated from the bolt and connected to the electrode. The electrode contact surface faces in a selected direction when the bolt is in battery. The bolt has an elongated clearance 64 cut away from the electrode contact surface and facing the selected direction when the bolt is turned for reciprocation. The frame includes the electrical contact facility 66 in the selected direction with respect to the bolt. The plurality of flexible contacts 68 contacts the electrode contact surface, and the plurality of flexible contacts 70 contacts the bolt. The electrical contact facility is rated for at least 1 ampere. However, amperage rating is less critical because of the pulsed operation of the electronic firing mechanism 10. Contact resistance is more important for each of the flexible contacts. The flexible contacts should each have a contact resistance of 50 milliohms or less. As an array of flexible contacts, the total contact resistance should be less than 10 milliohms when the flexible contacts are all engaged in a parallel connection. The electrical contact facility slidably engages the electrode contact surface. In the current embodiment, the flexible contacts 68, 70 are arranged in a row, with part of the row contacting the electrode contact surface and part of the row contacting the bolt.

To use the firearm with electronic firing mechanism 10, the shooter begins with the bolt 18 in a retracted position. In the retracted position, the flexible contacts 68, 70 cannot contact the electrode contact surface 62 because the electrode contact surface is rotated out of position. The flexible contacts 68, 70 also cannot contact the bolt because of the elongated clearance 64. The lack of contact with the electrode contact surface prevents the electric power delivery facility 36 from being operable in response to actuation of the trigger 42 to apply a voltage between the first and second connections 38, 40, which prevents inadvertent discharge of the firearm with electronic firing mechanism with the bolt unlocked. As the user slides the bolt forward using the bolt handle 72, the bolt strips the uppermost centerfire cartridge 30 from a magazine (not shown) and inserts the centerfire cartridge within the chamber 16 of the barrel 14. The bolt face 20 engages the case head 78 of the centerfire cartridge, and the tip 26 of the electrode 24 contacts the primer 28 as the centerfire cartridge is chambered. The user then pushes the bolt handle downward to rotate and secure the bolt in battery. Insertion of the centerfire cartridge within the chamber stops as the bolt reaches a forward limit of travel. When insertion stops, the bolt moves slightly forward against the case head, and the tip of the electrode is pushed rearward against the spring 48 back into the bolt. The electrical contact facility 66 is rotationally engaged with the bolt such that when the bolt is in battery, the flexible contacts 68, 70 contact the electrode contact surface 62 and bolt, respectively. This contact enables the electric power delivery facility to be operable in response to actuation of the trigger to apply a voltage between the first and second connections to discharge the firearm with electronic firing mechanism.

The electrical contact facility 66 is a printed circuit board with an insulated backing attached to the underside of a picatinny rail 80 by two bolts (not shown). The printed circuit board includes a protrusion 100 that facilitates connection of the printed circuit board with the electric power delivery facility 36 and a controller 94 by wires, copper busbars, or another suitable type of electrical conductor. The flexible contacts 68, 70 are soldered to the printed circuit board. The elongated clearance 64 is at least 1 mm deep to accommodate the full range of motion of the flexible contacts. The flexible contacts have an uncompressed height of 2.4 mm, and a working range (compressed height) of 1.4 mm to 2.0 mm. A compressed height between 2.0 mm and 2.4 mm does not provide enough spring force to make a low electrical resistance connection with the electrode contact surface 62.

The electrode element 52 is a flat bar of brass that is 4.5 mm wide, but could also be made of plated copper or another suitably machinable and electrically conductive material. The electrode element is insulated all the way around by a 2 mm-thick plastic liner 82. However, the plastic liner can also be much thinner because of the low voltages used. A 0.05 mm-thick plastic liner has been successfully used. The electrode element is secured within the plastic liner and attached to the bolt 18 within lateral opening 50 and to the electrode 24 by four M2 bolts 84. M2 bolts are required because of the small size of the electrode. Because the lateral opening must be milled, both ends of the slot will have a radius. The plastic liner is manufactured by 3D printing or another suitable method, such as turning on a lathe or otherwise being machined to have a matching radius. The radius is minimized by using a smaller endmill to mill out the corners. The bolt includes a ramp 98 that lifts the flexible contacts 68, 70 to contact the electrode contact surface 62 when the bolt is rotated as a centerfire cartridge 30 is chambered. The flexible contacts cannot be engaged with a sharp edge because their gold plating would be easily damaged by a steel edge. So, the ramp is machined in the bolt to enable the flexible contacts to be brought to their fully compressed heights gradually with reduced wear to their gold plating. The flexible contacts have a voltage rating of 15 VDC and a current rating of 4 amperes in the current embodiment. The flexible contacts are also rated to have a contact resistance of less than 50 milliohms when compressed to the specified height.

It should be appreciated that only flexible contacts 68, which are ¾ of the total flexible contacts 68, 70, contact the electrode contact surface 62. The remaining flexible contacts 70 are used to ground the bolt 18 by directly contacting the bolt to complete the electrical circuit. The portion of the bolt contacted by flexible contacts 70 needs to have the bluing removed and be polished to form a good contact surface 86. It is desirable to also plate the electrode contact surface with a wear and corrosion resistant metal before connecting the flexible contacts 70. The flexible contacts 68 that contact the electrode contact surface can be thought of as the positive side of a battery, and the flexible contacts 70 that ground the bolt can be thought of as the negative side of a battery. The polarity can also be flipped to improve lock time at the expense of firing pin wear. An additional ground may be established by securing a wire 54 to the barrel 14.

The electrode 24 has a brass body 88, and the tip 26 of the electrode is made of a copper-tungsten alloy, a refractory metal, for electrical conductivity and temperature resistance. The tip has a larger diameter rear portion 90 that is made by soldering the copper-tungsten alloy to a copper tube of an identical inner diameter and a larger outer diameter compared to the diameter of the tip. The rear portion of the tip has a diameter of 3 mm, and the smaller portion of the tip has a diameter of 2 mm. The tip cannot make physical contact with the bolt 18 to maintain electrical isolation. To prevent contact, the bolt face aperture 22 is a 2.5 mm hole drilled in the bolt face 20 that receives insulating spacer 32. A small lip 92 is left to support the insulating spacer, which is made of alumina ceramic material, which is much stronger in compression than in shear or tension.

The firearm with electronic firing mechanism 10 utilizes a pulse of electrical current provided via the electrode 24 to heat the primer 28 above the autoignition temperature of the priming compound to fire the centerfire cartridge 30. The electric current is provided by a low voltage and high current electric power delivery facility 36, such as a battery or cell. A standalone bench power supply also an option provided the bench power supply can deliver a high amount of current at low voltages. The pulse duration and energy delivered is controlled by controller 94. The controller adjusts the duration of the pulse based on power source voltage, primer type, and other parameters. This could a longer pulse for a high-resistance, oxidized primer. The tip 26 of the electrode is connected electrically in series through the electrical contact facility 66 to the controller and electric power delivery facility. When the trigger 42 is actuated, the controller senses the current and voltage delivered to the tip and controls the amount of time the electrical contact facility is conducting to limit the energy delivered to the primer. Upon the determination a specified amount of energy has been conducted to ensure the primer has ignited, the controller stops the flow of electrical current. The specified amount of energy can be a preset value obtained from empirical experimentation for a specific cartridge type, or it can be user adjustable. The controller and electric power delivery facility can be housed in the stock 96 or other suitable location of the firearm with electronic firing mechanism. Poor control over the energy delivered either results in misfires or premature wear and failure of the firing pin after a few dozen cycles. Proper control over energy delivery, which is enabled by the controller, allows the firing pin to last at least a thousand cycles. Optimization of energy delivery also maximizes the battery life.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm with electronic firing mechanism has been described in detail, it should be apparent that modifications and variations thereto are possible, all of which fall within the true spirit and scope of the invention. Although rifles have been disclosed, the firearm with electronic firing mechanism is also suitable for use with pistols, shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame including a barrel chambered for a conventionally primed cartridge;

a bolt operably connected to the frame and having a bolt face facing the chamber and defining a bolt face aperture;

an electrode connected to the bolt and having a tip received in the bolt face aperture and facing the chamber;

the tip being configured to contact a primer of a centerfire cartridge received in the chamber when the bolt is in a battery condition;

the electrode being electrically isolated from the bolt and from the frame;

an electric power delivery facility having a first connection to the electrode and a second connection to at least one of the barrel, the bolt and the frame;

a trigger operably connected to the electric power delivery facility;

the electric power delivery facility operable in response to actuation of the trigger to apply a voltage between the first and second connections, such that thermal energy at a contact between the electrode tip and the primer discharges the centerfire cartridge;

wherein the bolt defines a lateral opening, and wherein an electrode element connected to the electrode extends through the lateral opening and has an exposed contact face; and wherein the bolt is an elongated body, and the lateral opening is at an intermediate location along the length of the bolt.

2. The firearm of claim 1 wherein the bolt defines a bore, and the electrode is received within the bore.

3. The firearm of claim 1 including an insulating spacer between the electrode and the bolt.

4. The firearm of claim 1 wherein the tip protrudes from the bolt face.

5. The firearm of claim 1 wherein the electrode remains stationary during discharge of the firearm.

6. The firearm of claim 1 wherein the electrode is spring biased with respect to the bolt, toward the chamber.

7. The firearm of claim 1 wherein the electrode reciprocates a limited distance with respect to the bolt.

8. The firearm of claim 7 wherein the limited distance is less than 0.05 inch.

9. The firearm of claim 1 wherein the bolt is an elongated body, and the lateral opening is forward of a rear end of the bolt.

10. The firearm of claim 1 wherein the bolt is an elongated body, and the lateral opening is closer to a forward end of the bolt than to a rear end of the bolt.

11. The firearm of claim 1 wherein the bolt has a lateral surface including an electrode contact surface isolated from the bolt and connected to the electrode.

12. The firearm of claim 11 wherein the electrode contact surface faces in a selected direction when the bolt is in battery.

13. A firearm comprising:

a frame including a barrel chambered for a conventionally primed cartridge;

a bolt operably connected to the frame and having a bolt face facing the chamber and defining a bolt face aperture;

an electrode connected to the bolt and having a tip received in the bolt face aperture and facing the chamber;

the tip being configured to contact a primer of a centerfire cartridge received in the chamber when the bolt is in a battery condition;

the electrode being electrically isolated from the bolt and from the frame;

an electric power delivery facility having a first connection to the electrode and a second connection to at least one of the barrel, the bolt and the frame;

a trigger operably connected to the electric power delivery facility;

the electric power delivery facility operable in response to actuation of the trigger to apply a voltage between the first and second connections, such that thermal energy at a contact between the electrode tip and the primer discharges the centerfire cartridge;

wherein the bolt has a lateral surface including an electrode contact surface isolated from the bolt and connected to the electrode;

wherein the electrode contact surface faces in a selected direction when the bolt is in battery; and wherein the bolt has an elongated clearance cut away from the electrode contact surface and facing the selected direction when the bolt is turned for reciprocation.

14. The firearm of claim 12 wherein the frame includes an electrical contact facility in the selected direction with respect to the bolt.

15. The firearm of claim 14 wherein the electrical contact facility includes a plurality of flexible contacts.

16. The firearm of claim 14 wherein the electrical contact facility is rated for a contact resistance less than 10 milliohms.

17. The firearm of claim 14 wherein the electrical contact facility slidably engages the electrode contact surface.

18. The firearm of claim 1 including a centerfire cartridge received in the chamber and having a primer operable to discharge the cartridge in response to a forceful mechanical impact greater than a selected safety threshold.

* * * * *